United States Patent [19]

Conklin

[11] 4,047,070

[45] Sept. 6, 1977

[54] PYROELECTRIC VIDICON HAVING TARGET HEATING MEANS ON ACCELERATING ANODE

[75] Inventor: Thomas Conklin, North Seituate, R.I.

[73] Assignee: North American Philips Corporation, New York, N.Y.

[21] Appl. No.: 732,734

[22] Filed: Oct. 15, 1976

[51] Int. Cl.[2] ..... H01J 29/45; H01J 29/08

[52] U.S. Cl. ..... 313/388; 313/458

[58] Field of Search ..... 313/388, 384, 101, 389, 313/380

*Primary Examiner*—Robert Segal

*Attorney, Agent, or Firm*—Frank R. Trifari; Carl P. Steinhauser

[57] ABSTRACT

A pyroelectric vidicon employs heating means for stabilizing the target temperature.

2 Claims, 1 Drawing Figure

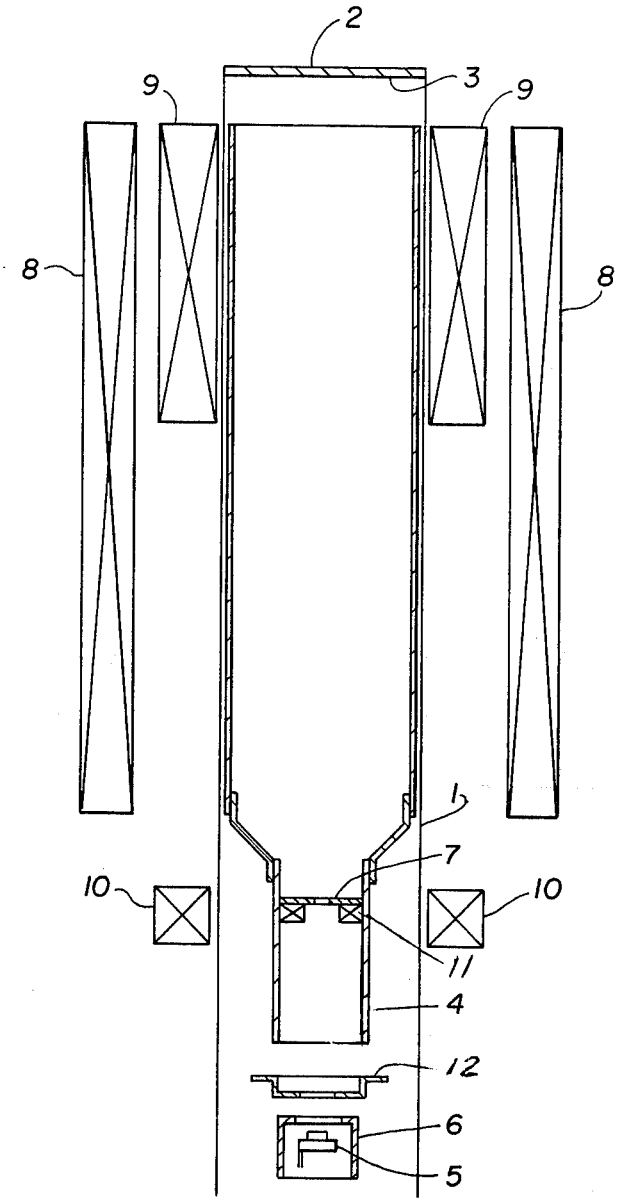
2
3
9
9
8
8
1
7
10
10
11
4
12
6
5

PYROELECTRIC VIDICON HAVING TARGET HEATING MEANS ON ACCELERATING ANODE

This invention relates to a pyroelectric vidicon employing an electron gun incorporating heating means for stabilizing the target temperature at a desired value.

Materials used as targets for pyroelectric vidicons have parameters that vary over a large range depending upon the temperature of the material. The two primary parameters are the dielectric constant ($\epsilon_R$) and the pyroelectric coefficient ($\pi$). The pyroelectric signal available is a function of $\pi$, and the amount that is effectively used is a function of $\epsilon_R$. Thus, there is an optimum temperature for the target.

In a standard pyroelectric vidicon employing a standard one-half watt thermionic cathode, the target, e.g. triglycine sulfate (TGS), is maintained at about 45° C by heat radiated from an electrode containing a beam-limiting aperture which is heated by the power dissipated from the high currents striking this electrode. The temperature, however, at which the target is maintained using this phenomenon is uncontrolled.

Furthermore, new pyroelectric materials, such as triglycine fluoberyllate (TGFB), that require higher temperatures for optimum performance, and new vidicon guns which do not have the electrode which dissipates power to the target, will be used in the newer generation pyroelectric vidicon.

It is an object of this invention to stabilize the target temperature of a pyroelectric vidicon using a separate, or auxiliary heating means in association with the electron gun. In accordance with the invention, a resistive heater is incorporated on an anode of the gun which can be heated by the passage of current. The heater can be controlled externally by a separate variable power supply, or after the determination of the appropriate current, the proper resistor can be used to draw current through the heater from one of the anode supplies. No more than 0.25 watts should be dissipated in this heater to maintain the target at about 55° C which is the optimum temperature for some of the new pyroelectric materials.

The invention will be described with reference to the accompanying drawing, the sole FIGURE of which shows a pyroelectric vidicon according to the invention.

The pyroelectric vidicon according to the invention comprises an evacuated envelope 1 having a window 2 transparent to infra-red radiation at one end on which a pyroelectric target 3, usually tri-glycine sulfate (TGS), is mounted, but in new tubes it may be tri-glycine fluoberyllate (TGBF) or deuterated tri-glycine fluoberyllate (DTGFB), and housing at the other end an electron gun, generally designated 4 which produces an electron beam.

The electron gun 4 further comprises an electron emissive cathode 5 surrounded by a first anode 6 having the limiting aperture apertures for the electron beam. A second anode 4 which tapers at one end toward the cathode and has a diaphragm 7 is spaced from the first anode. Between the first and second anodes there is a focus electrode 12. Surrounding the second anode 7 is a focussing coil 8, for focussing the electron beam, and a deflection coil 9 for causing the electron beam to scan the target. An alignment coil 10 is also positioned about the second anode.

In accordance with the invention, a heating element 11 is positioned before the diaphragm 7 which heats the target 3 by radiation to a desired temperature. In order to energize this heater, it is connected either to a separate variable power supply (not shown) or to an anode supply. In any case, the amount of energy required to maintain the target at the desired temperature should not exceed 0.25 watts.

What is claimed is:

1. In a pyroelectric vidicon having a thermally responsive target, an electron gun for generating an electron beam, and means to scan the target with said electron beam, the improvement wherein said electron gun comprises an electron emissive cathode, an accelerating anode including a diaphragm, and heating means on the side of said diaphragm facing said cathode for maintaining the target at a desired temperature.

2. A pyroelectric vidicon as claimed in claim 1 in which the heating means is a resistive heater.

* * * * *